US009765628B2

(12) United States Patent
Miyoshi et al.

(10) Patent No.: US 9,765,628 B2
(45) Date of Patent: Sep. 19, 2017

(54) TURBINE ROTOR BLADE

(75) Inventors: Ichiro Miyoshi, Mito (JP); Shinichi Higuchi, Hitachinaka (JP); Masami Noda, Hitachinaka (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 86 days.

(21) Appl. No.: 13/702,557

(22) PCT Filed: Dec. 7, 2011

(86) PCT No.: PCT/JP2011/006838
§ 371 (c)(1),
(2), (4) Date: Mar. 13, 2013

(87) PCT Pub. No.: WO2013/084260
PCT Pub. Date: Jun. 13, 2013

(65) Prior Publication Data

US 2014/0294557 A1 Oct. 2, 2014

(51) Int. Cl.
*F01D 5/18* (2006.01)
*F01D 5/20* (2006.01)

(52) U.S. Cl.
CPC ..... *F01D 5/18* (2013.01); *F01D 5/186* (2013.01); *F01D 5/20* (2013.01); *F01D 5/187* (2013.01); *F05D 2260/202* (2013.01)

(58) Field of Classification Search
CPC ... F01D 5/18; F01D 5/186; F01D 5/20; F01D 5/187; F05D 2260/202
(Continued)

(56) References Cited

U.S. PATENT DOCUMENTS 4,424,001 A * 1/1984 North ..... F01D 5/20 415/115
6,059,530 A * 5/2000 Lee ..... F01D 5/145 416/96 A
6,102,655 A 8/2000 Kreitmeier
6,190,129 B1 2/2001 Mayer et al.
6,736,596 B2 5/2004 Ito et al.
(Continued)

FOREIGN PATENT DOCUMENTS

GB 2 111 131 A 6/1983
JP 55-165901 U 11/1980
(Continued)

OTHER PUBLICATIONS

Japanese-language International Search Report dated Mar. 6, 2012 including partial English-language translation (Six (6) pages).
(Continued)

*Primary Examiner* — Mark Laurenzi
*Assistant Examiner* — Dapinder Singh
(74) *Attorney, Agent, or Firm* — Crowell & Moring LLP

(57) ABSTRACT

A turbine rotor blade is provided that can reduce a total pressure loss at a blade cross-section on a tip side of the blade and suppress degradation in performance even if cooling air mixes in toward the blade. The rotor blade is mounted to a rotor to form a turbine blade row rotating in a stationary member that includes a platform forming a gas passage through which a mainstream gas flows and an airfoil extending from a gas passage plane in a radial direction vertical to the rotational axis of the rotor, the gas passage plane being a plane of the platform and forming the gas passage. A clearance between the tip-side end face, which is a leading end-side end face of the airfoil, and the stationary member facing the tip-side end face is smaller on the downstream side than on the upstream side.

5 Claims, 9 Drawing Sheets

(58) Field of Classification Search
USPC ..... 416/95, 97 R, 228
See application file for complete search history.

(56) References Cited

U.S. PATENT DOCUMENTS

| | | | | |
|---|---|---|---|---|
| 8,206,108 | B2 * | 6/2012 | Riahi | F01D 5/147 416/228 |
| 9,085,988 | B2 * | 7/2015 | Kwon | F01D 5/20 |
| 2009/0324422 | A1 | 12/2009 | Klasing et al. | |
| 2010/0111674 | A1 | 5/2010 | Sparks | |
| 2011/0070072 | A1 | 3/2011 | Subramaniyan | |
| 2012/0288360 | A1 | 11/2012 | Kuwamura et al. | |
| 2013/0232991 | A1 * | 9/2013 | Otero | F01D 5/187 60/806 |

FOREIGN PATENT DOCUMENTS

| | | | |
|---|---|---|---|
| JP | 10-82302 | A | 3/1998 |
| JP | 10-252405 | A | 9/1998 |
| JP | 10-311205 | A | 11/1998 |
| JP | 11-148308 | A | 6/1999 |
| JP | 2000-291404 | A | 10/2000 |
| JP | 2002-227606 | A | 8/2002 |
| JP | 2002-371802 | A | 12/2002 |
| JP | 2006-291967 | A | 10/2006 |
| JP | 2008-51096 | A | 3/2008 |
| JP | 2010-112379 | A | 5/2010 |
| JP | 2011-69361 | A | 4/2011 |
| JP | 2011-208602 | A | 10/2011 |

OTHER PUBLICATIONS

Japanese-language Written Opinion (PCT/ISA/237) dated Mar. 6, 2012 (Seven (7) pages).

Extended European Search Report dated Jul. 28, 2015 (Six (6) pages).

* cited by examiner

TURBINE ROTOR BLADE

TECHNICAL FIELD

The present invention relates to turbine rotor blades and more particularly to a turbine rotor blade for which mixing-in of gas from a casing side is taken into account.

BACKGROUND ART

FIG. 2 shows the blade surface Mach number at a blade cross-section on the tip side of a turbine rotor blade. The blade surface Mach number from the leading edge to trailing edge of a suction surface at the tip of a rotor blade is denoted by symbol Ms. The blade surface Mach number from the leading edge to trailing edge of a pressure surface is denoted by symbol Mp. As shown in FIG. 2, the blade surface Mach number of the suction surface indicates the maximum blade surface Mach number M_max at an intermediate portion between the leading edge and trailing edge of the blade and largely decreases from the intermediate portion to the trailing edge of the blade. A difference in the blade surface Mach number between the suction surface and the pressure surface produces a difference in pressure between the suction surface and the pressure surface, which will rotate the rotor blade.

However, if cooling air mixes in from a casing side, i.e., from the further outer circumferential side of the rotor blade, the cooling air interferes with the rotor blade. As shown in FIG. 3, the blade surface Mach number of the suction surface lowers as indicated by symbol M'_max, so that the pressure difference acting on the rotor blade decreases. This is because the interference of the cooling air with a mainstream fluid loses energy, which leads to no gas expansion. As a result, a total pressure loss increases at a blade cross-section of the tip of an airfoil.

In patent documents 1 and 2, the reason for the increasing total pressure loss lies in low-speed air that flows from the pressure surface toward the suction surface through between the tip and the casing. Thus, the technology is disclosed for sealing the flow of the low-speed air between the tip and the casing.

Patent document 3 proposes the following technology in addition to the technology for reinforcing the seal at the tip. An inflow angle with respect to the leading edge of a rotor blade is varied in a blade-height direction to reduce a blade-load on the tip. This reduces a difference in pressure between the suction pressure and the pressure surface, whereby a flow rate of low-speed air flowing from the pressure surface to the suction surface is reduced to achieve a reduction in loss.

PRIOR ART DOCUMENTS

Patent Documents

Patent document 1: JP-2002-227606-A
Patent document 2: JP-2008-51096-A
Patent document 3: JP-2010-112379-A

SUMMARY OF THE INVENTION

Problem to be Solved by the Invention

The technologies described in patent documents 1 and 2 largely contribute to the straightening of flow if an amount of cooling air mixing in from the casing side is small.

However, if the mixing-in amount of cooling air is large, it is difficult to perform the sufficient straightening. Therefore, the cooling air induces a secondary flow from the leading edge 18. Consequently, the blade surface Mach number on the tip side decreases, which leads to a steep reduction in pressure difference acting on the rotor blade.

The technology described in patent document 3 cannot be applied to many cases for the reason that the twist of the blade is increased if the blade height is low. Further, if the blade surface is curved, low-speed fluid not only on the tip 15 side but on the platform 44 side may probably roll up to the vicinity of the average diameter of the blade. Thus, if a mixing-in amount of cooling air increases, there is concern that deterioration in the performance of the rotor blade may be even more amplified As described above, the technologies that have heretofore been applied has concern that the performance of the turbine rotor blade is largely affected by the flow rate of the mixing-in cooling air. In addition, also the applicable range of the technologies is largely affected by the blade height or the like. For a hot gas, the turbulence of a flow field on the tip side has a large influence on the blade portion. More specifically, the turbulence of the flow field increases heat flux from the fluid side toward the blade portion, which causes an increase in thermal load exerted on the blade. Such an increase in thermal load causes the breakage of the blade.

It is an object of the present invention, therefore, to provide a turbine blade that achieves an improvement in turbine efficiency.

Means for Solving the Problem

A turbine rotor blade mounted to a rotor to form a rotating turbine blade row is characterized by including a platform forming a gas passage through which a mainstream gas flows; and an airfoil extending from a gas passage plane in a radial direction in which a distance from a rotational axis of the rotor increases, the gas passage plane being a plane of the platform and forming the gas passage, and in that the airfoil has, in an end face of a tip-side thereof, an area where an inclination with respect to the rotational axis is varied, and a blade height which is a height of the airfoil in the radial direction is configured such that a blade height at a leading edge of the airfoil is lower than a blade height at a throat position on a suction surface of the airfoil.

Effect of the Invention

The present invention can provide a turbine blade that achieves an improvement in turbine efficiency.

MODE FOR CARRYING OUT THE INVENTION

Figure 1:
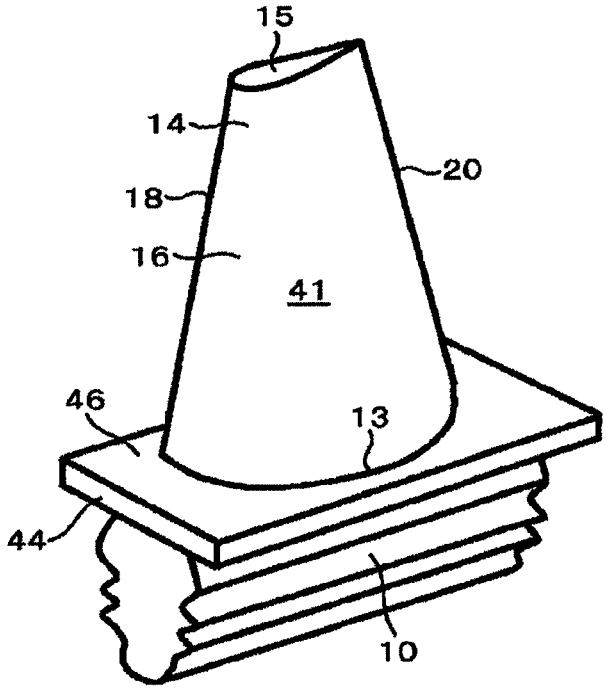
FIG. 1 is a perspective view of a typical turbine rotor blade.
Figure 2:
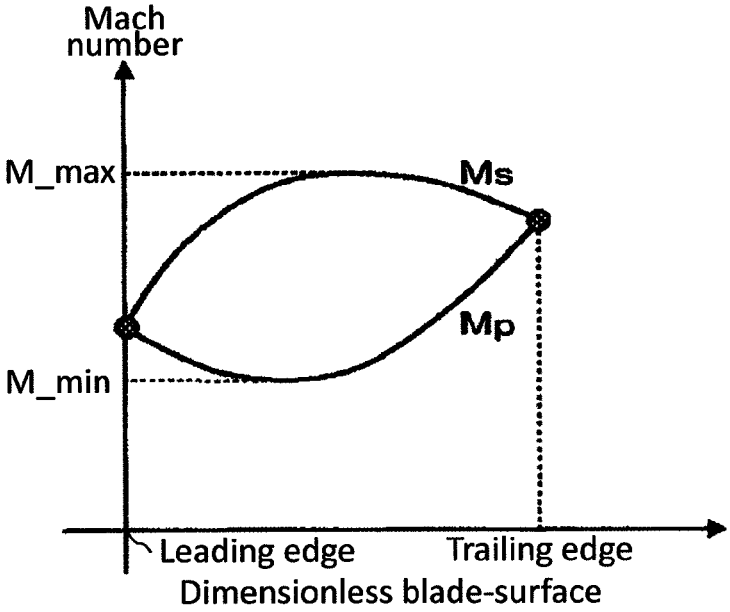
FIG. 2 is an explanatory diagram showing a Mach number distribution on a tip-side surface of the turbine blade.
Figure 3:
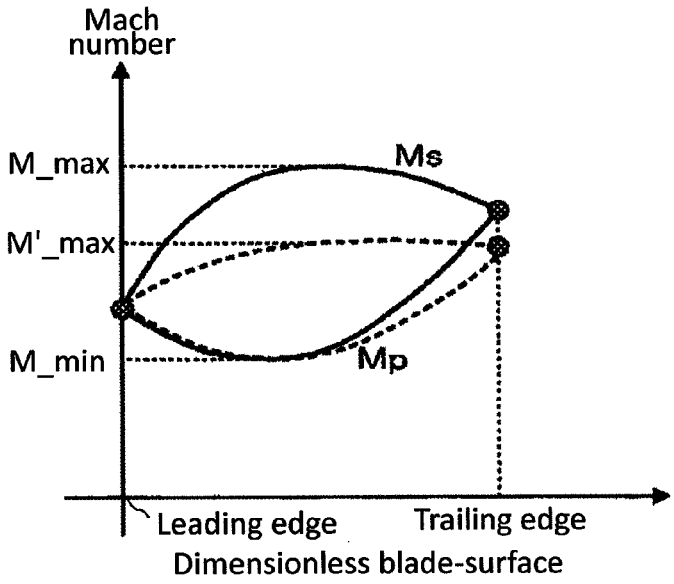
FIG. 3 is an explanatory view showing a Mach number distribution on the tip-side surface of the turbine blade, in which an influence of the mixing-in of cooling air is taken into account.

A description will first be given of a basic configuration of a turbine rotor blade with reference to FIG. 1. The blade shown in FIG. 1 has a platform 44 and an airfoil 41. The platform 44 forms a gas passage through which a main stream gas flows by an upper surface 46 thereof that is symmetrically provided with respect to a rotational axis. The airfoil 41 extends from the upper surface 46 of the platform 44 in a direction where a radial distance increases therefrom. The airfoil 41 has a pressure surface 14 formed in a concave shape in a blade-chordal direction and a suction surface 16 formed in a convex shape 16 in the blade-chordal direction, a leading edge 18 and a trailing edge 20.

A hub 13 of the airfoil 41 adjoins the upper surface 46 of the platform 44. The hub 13 constitutes the airfoil such that the blade thickness is gradually increased as it goes from the leading edge side toward the central side and is gradually decreased as it goes from the middle of the blade toward the trailing edge side. The airfoil 41 may be formed to have a hollow portion therein adapted to allow a cooling medium to flow therein to cool the blade from the inside.

Figure 4:
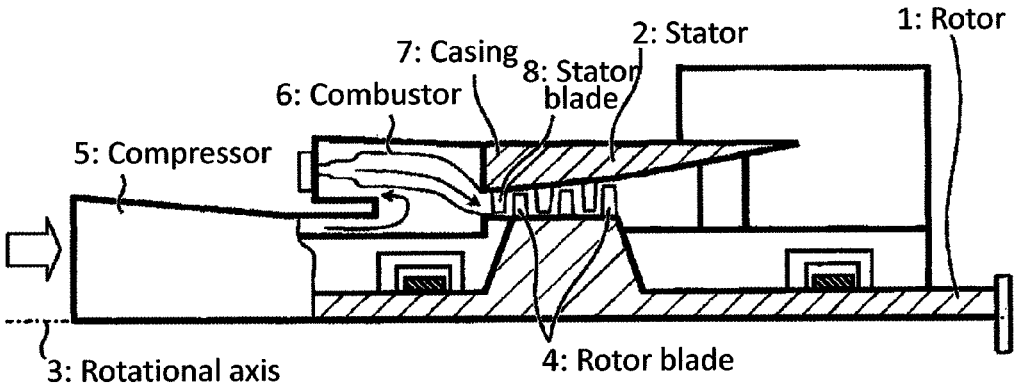
FIG. 4 is a partial cross-sectional view of a gas turbine.

A basic configuration of a gas turbine is next described with reference to FIG. 4. FIG. 4 is a partial cross-sectional view showing the outline of the gas turbine. The gas turbine is mainly composed of a rotor 1 and a stator 2. The rotor 1 mainly includes rotor blades 4 and rotator blades of a compressor 5 and is rotated around a rotational axis 3 as an axis. The stator 2 is a stationary member mainly having a casing 7, a combustor 6 supported by the casing and disposed to face the rotor blades, and stator blades 8 serving as nozzles for the combustor.

A description is given of the general operation of the gas turbine configured as above. Air compressed by the compressor 5 and fuel is supplied to the combustor 6, in which these fuels are burned to produce a hot gas. The hot gas thus produced is jetted to the rotor blades 4 via the corresponding stator blades 8 to drive the rotor via the rotor blades. The gas turbine is needed to cool particularly the rotor blades 4 and the stator blades 8 exposed to the hot gas. The air compressed by the air compressor 5 is partially used as a cooling medium for the blades.

A plurality of the rotor blades 4 are installed in the circumferential direction of the rotor 1 to constitute a turbine blade row. Between the rotor blades 4 adjacent to each other serves as a passage for working gas. The compressor 5 is frequently used as a cooling air supply source for the rotor blades 4. Cooling air is led to the rotor blades 4 via cooling air introduction holes provided in the rotor 1.

Figure 5:
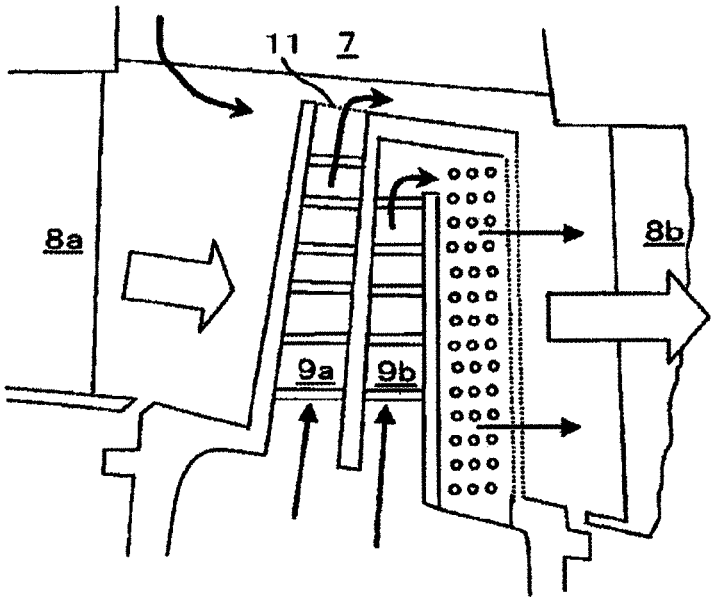
FIG. 5 is a cross-sectional view for assistance in explaining a cooled blade of a gas turbine, taken along a meridian plane.

FIG. 5 illustrates a rotor blade provided with a specific cooling structure by way of example. A solid line arrow denotes the flow of cooling air and a framed arrow denotes the flow of a mainstream hot gas, i.e., of a mainstream working gas. The cooling air led to the rotor blade 4 by use of the cooling air introduction holes passes through cooling passages 9*a*, 9*b* installed inside the blade and is finally discharged to a main stream working gas passage from discharge holes 11 and the like, to be mixed with the mainstream hot gas.

Figure 6:
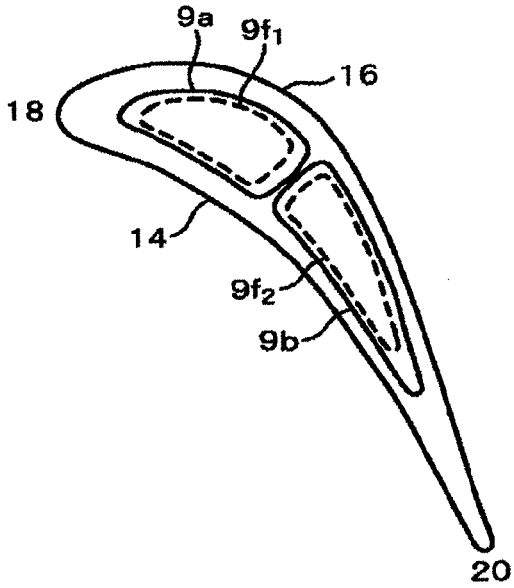
FIG. 6 is a cross-sectional view for assistance in explaining the cooled blade of the gas turbine, taken at its radial position.

FIG. 6 is a cross-sectional view of the rotor blade illustrated in FIG. 5. Reference numeral 14 denotes the pressure surface (the blade belly portion), 16 denotes the suction surface (the blade back portion), 18 denotes the leading edge and 20 denotes the trailing edge. Reference numerals 9*a* and 9*b* denote the cooling passages illustrated in FIG. 5. The rotor blade illustrated in FIG. 6 is provided with fins $\mathbf{9}_{f1}$, $\mathbf{9}_{f2}$ for the purpose of satisfactory thermal conversion. As illustrated in FIG. 5, the cooling air after cooling is discharged through the exhaust holes and then is discharged into a gas path. Incidentally, the cooling structure may be convection cooling or other cooling means. What is important is a profile shape on the tip side of the turbine rotor blade from which the cooling air mentioned above is discharged.

Figure 7:
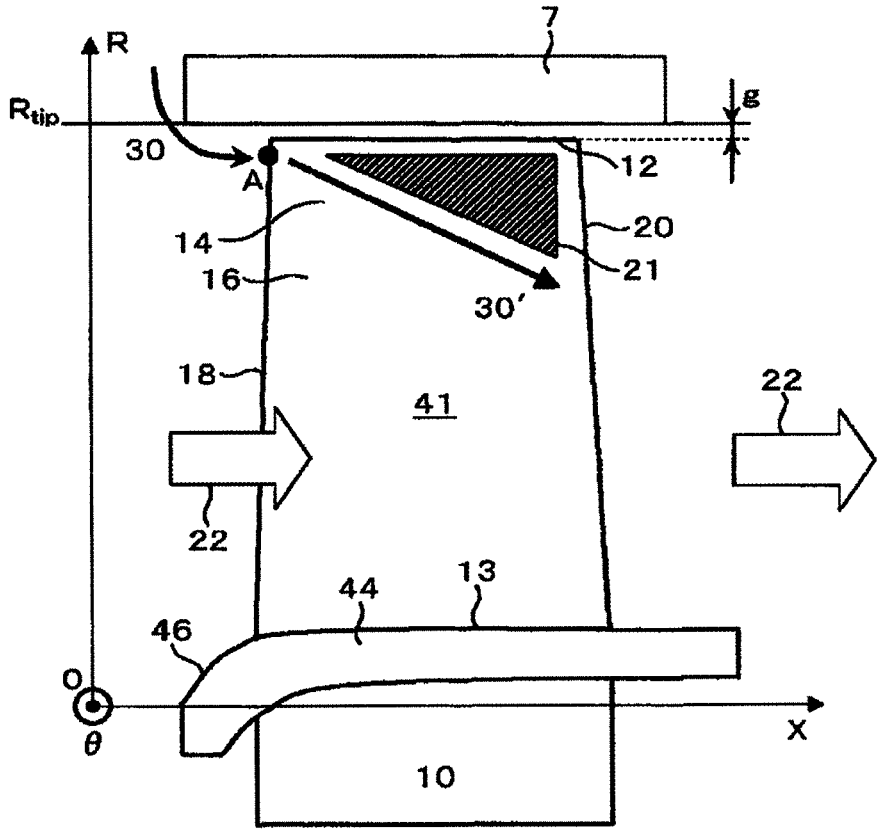
FIG. 7 is an explanatory diagram showing a meridian plane of a conventional turbine blade.

A description is here given of an influence of the cooling air 30 mixing in from the casing side on the airfoil 41 of the rotor blade. In FIG. 7, solid line arrows denote the flow of cooling air. An R-axis indicates a coordinate showing a distance from the rotating axis 3 of the rotor and a positive direction indicates an increase in radial distance from an origin. Symbol $R_{tip}$ indicates a position of the casing 7 on the R-axis. An X-axis is a coordinate parallel to the turbine rotational axis, in which a positive direction indicates a move direction of a mainstream gas 22 from the upstream toward the downstream. FIG. 7 illustrates the rotor blade projected on a coordinate plane defined by the R-axis and the x-axis, and is referred to as a meridian plane diagram of the rotor blade.

The turbine rotor blade illustrated in FIG. 7 has a dovetail-shaped root portion 10 used to mount the turbine rotor blade to a rotor, a platform 44 disposed on the root portion 10, and an airfoil 41 extending from an upper surface 46 of the platform 44 in an R-axial direction. The airfoil 41 forms a hub (a root) 13 adjacent to the upper surface 46 of the platform 44 and a tip (an end) 15 located at the end of the blade, and has a pressure surface (a belly surface) 14 formed in a concave shape in a blade-chordal direction, a suction surface (a back surface) 16 formed in a convex shape in the blade-chordal direction, a leading edge 18 and a trailing edge 20.

If cooling air 30 mixes in from the casing 7 side, the cooling air 30 thus mixing in does not pass through a gap g located between an end face 12 on the tip side of the blade and the casing 7 but rolls up at point A on the suction surface 16 side of the blade. A solid line arrow denotes the flow of cooling air 30' rolled up on the suction surface 16 side of the blade. As shown in FIG. 7, the rolled-up cooling air 30' flows down in a mainstream gas passage while shifting in the direction where a radial distance between rotor blades is reduced.

The flow of the mainstream gas 22 is blocked by the flow 30' of the rolled-up cooling air and the mainstream gas 22 mixes with the cooling air, which causes an energy loss. An effect in which the cooling air blocks the mainstream gas is called a blockage effect. Due to the blockage effect, an area 21 surrounded by the flow 30' of the rolled-up cooling air and a tip-type end face 12 of the rotor blade becomes an area where the energy of fluid is low. Therefore, the larger this area, the smaller the proportion of the energy of the mainstream gas 22 converted into the rotational energy for the airfoil 41 of the blade.

The mixing of the hot mainstream gas with the low-temperature cooling air as described above reduces the enthalpy of the mainstream gas. The proportion of the energy converted into the rotational energy for the rotor blade is reduced. Thus, what is important is to reduce the area 21 where the cooling air and the mainstream gas 22 mixes with each other.

Embodiment 1

Figure 8:
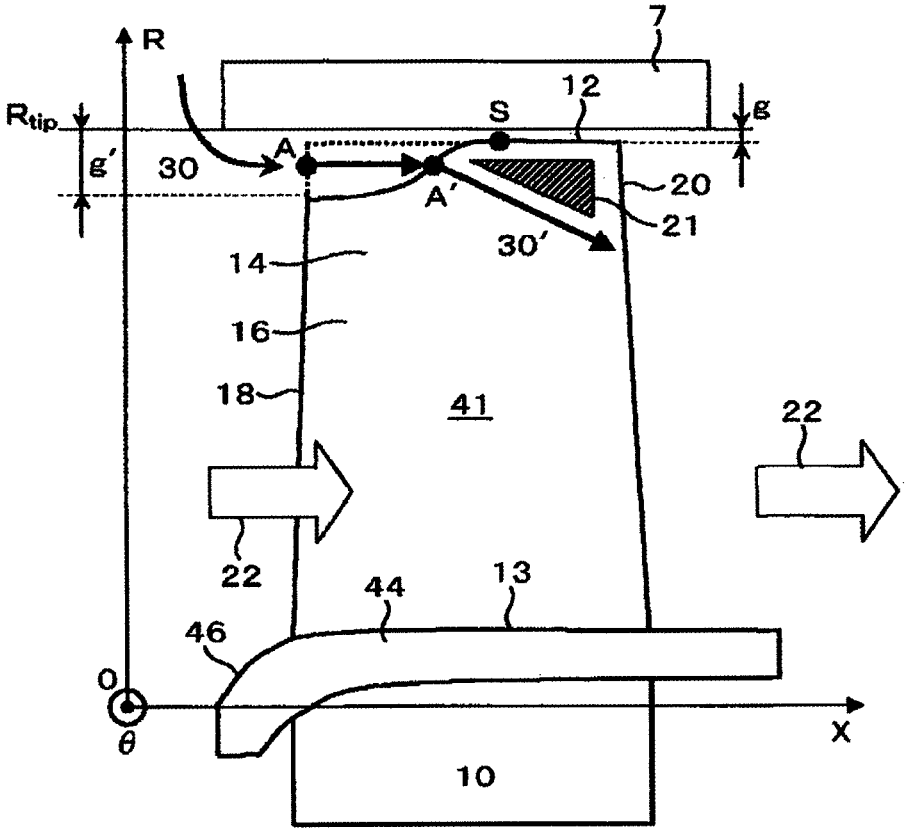
FIG. 8 is an explanatory diagram showing a meridian plane of a turbine blade according to a first embodiment of the present invention.

FIG. 8 is a meridian plane diagram of a turbine rotor blade according to a first embodiment. As shown in FIG. 8, a turbine rotor blade of the present embodiment is formed such that a clearance g' between a casing 7 and a rotor blade tip-side end face 12 on the upstream side is greater than a clearance g on the downstream side. More specifically, the tip-side end face 12 of the turbine rotor blade is inclined so that the clearance between the casing 7 and the tip-side end face 12 of the blade is progressively reduced as it goes toward the downstream side. Thus, the inclination of the tip-side end face 12 of the blade is varied with respect to an X-axis. In addition, the inclination with respect to the X-axis is varied so that a blade height, i.e., an R-axial length of an airfoil at a point S, i.e., at a throat position on a suction surface may be higher than the height of the airfoil at a leading edge 18.

In this manner, the clearance g' is formed greater than the clearance g; therefore, a point where cooling air 30 comes into contact with the airfoil 41 to roll up can be shifted in a downstream direction from point A to point A', so that an area 21 can be reduced. However, if the gap g' is set to an excessive large level, even an area that is not affected by the cooling air may probably be reduced. It is desired, therefore, that the clearance g' be approximately 2 to 3 times the clearance g although an optimum value differs depending on the size of the blade or the mixing-in amount of cooling air.

That is to say, according to the turbine rotor blade of the present embodiment, the clearance between the tip-side end face 12 and the casing 7 is formed smaller on the downstream side in the flow direction of the mainstream gas 22 than on the upstream side. Therefore, the area 21 where the cooling air 30 mixes with the mainstream gas 21 is reduced. Thus, the proportion of the energy of the mainstream gas converted into the rotational energy for the rotor blade is increased in the turbine rotor blade. In addition, a blockage effect due to the influence of cooling air can be reduced, so that also expansion work on the airfoil 41 of the rotor blade can be made smooth in the R-axial direction.

As described above, the turbine rotor blade of the present embodiment can reduce a total pressure loss at the cross-section on the tip side thereof. Even if cooling air mixes with the mainstream gas, performance degradation can be suppressed. Thus, an improvement in turbine efficiency can be enabled. Since an area where a flow field is turbulent can be reduced, also a thermal load acting on the blade can be reduced.

Embodiment 2

Figure 9:
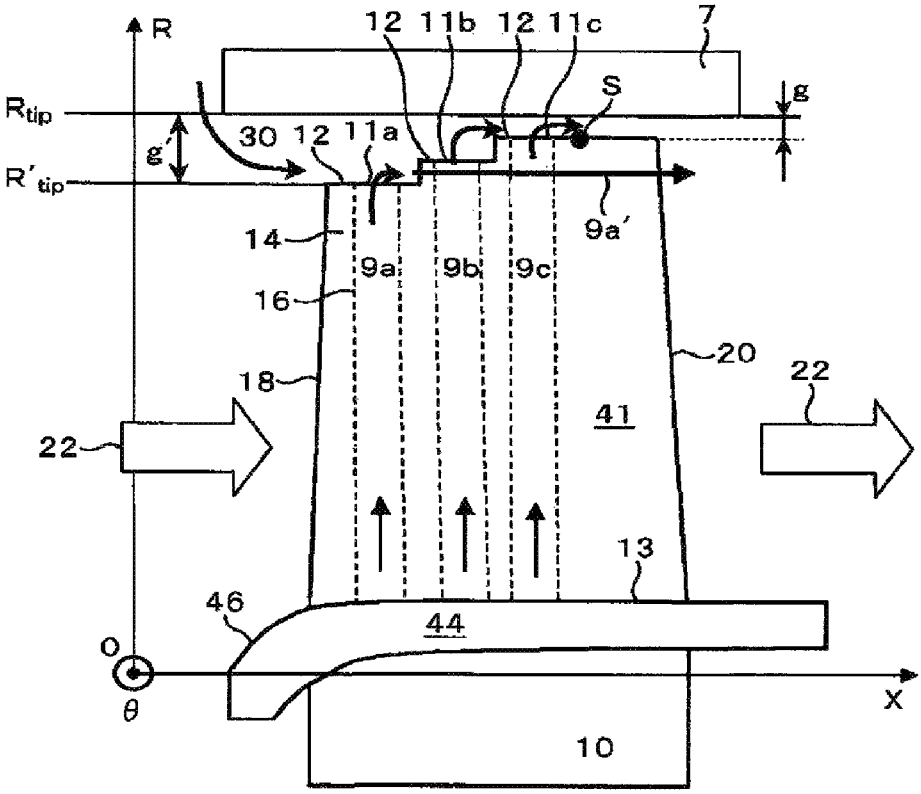
FIG. 9 is an explanatory diagram showing a meridian plane of a turbine blade according to a second embodiment of the present invention.

FIG. 9 illustrates a second embodiment. In the present embodiment, the inclination in the first embodiment is modified into steps. Specifically, a radial position of a tip-side end face 12 of an airfoil 41 is varied stepwise in an X-axial direction. Along with this configuration, a clearance between a casing 7 and an end face 12 on the tip side of a rotor blade is progressively increased as it goes toward the upstream side in the flow direction of mainstream gas and is progressively reduced as it goes toward the downstream side. With this configuration, also the turbine rotor blade of the present embodiment can reduce a total loss at the cross-section on the tip side thereof and a thermal load acting thereon, similarly to the turbine rotor blade of the first embodiment.

The turbine rotor blade of the present embodiment has therein cooling passages 9*a*, 9*b*, 9*c* adapted to allow the cooling air supplied from a blade root side to flow down toward the tip side to cool the airfoil 41. As shown in FIG. 9, the cooling air that has flowed down in the cooling passages 9*a*, 9*b*, 9*c* is discharged from discharge holes provided in the tip-side end face 12 into a mainstream gas passage and mixes with the mainstream gas 22.

In FIG. 9, the flow of the cooling air that has flowed down the cooling passage 9*a* to cool the airfoil 41 is denoted by reference numeral 9*a*'. An R-axis indicates a coordinate showing a distance of the airfoil 41 of the turbine rotor blade from a rotational axis. A positive direction indicates an increase in radial distance. Symbol $R_{tip}$ indicates a radial position of the casing 7. Symbol $R'_{tip}$ indicates the radial position of a face where a radial distance from the rotational axis of the airfoil 41 is shortest, in the tip-side end face 12 of the airfoil 41.

As shown in FIG. 9, an area where the flow 9*a*' of the cooling air discharged from the cooling passage 9*a* exists is included in an area (the range of symbol g') between $R_{tip}$ and $R'_{tip}$. This is because the area where the cooling air 30 mixes with the mainstream gas 22 is reduced, so that the cooling air 30 flows on the blade surface as illustrated in FIG. 8. Thus, the cooling air cools the blade surface. The cooling air has an effect of shielding heat flux from the mainstream gas 22 toward the airfoil 41.

Figure 10:
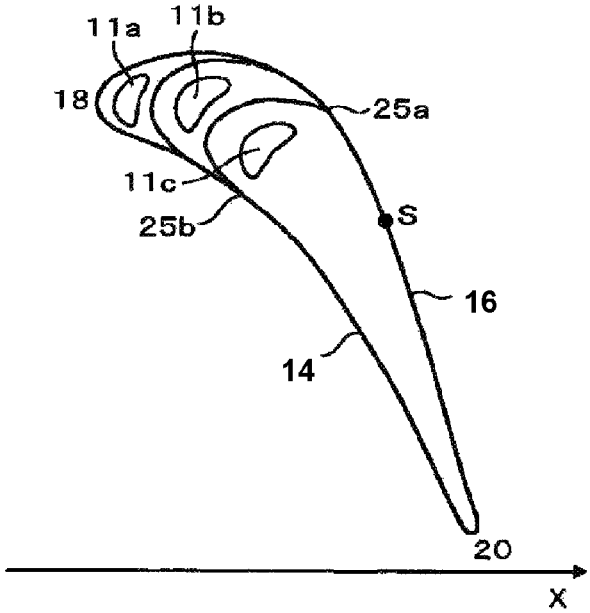
FIG. 10 is a cross-sectional view for assistance in explaining the turbine blade according to the second embodiment taken, at its radial position.

FIG. 10 illustrates the tip-side end face 12 encountered when the airfoil 41 shown in FIG. 9 is viewed from the casing 7 side. Reference numerals 11*a*, 11*b* and 11*c* denote discharge holes adapted to discharge the cooling air that has flowed down the cooling passages 9*a*, 9*b* and 9*c*, respectively, to cool the airfoil 41. Among the three air discharge holes, the air discharge hole 9*a* is located at a position where the radial position of the R-axis is lowest. The air discharge hole 9*c* is located at a position where the radial position of the R-axis is highest. The air discharge hole 9*c* is located at an intermediate position between the air discharge holes 9*a* and 9*c* with respect to the radial position. Incidentally, the air discharge holes may have any size. The air exhaust hole may not exist in each step depending on the internal cooling structure of the blade.

What is important in the present embodiment is the shape of the leading edge of each step located at the uppermost stream in the cross-sectional shape thereof. A point where a cross-section which is present at the highest radial position and at which the air discharge hole 9*c* is located is in contact with the suction surface is denoted by reference numeral 25*a* and a point in contact with the pressure surface is denoted by reference numeral 25*b*. The point 25*a* is set at point S, i.e., at a throat position on the suction surface, or at a point located on the upstream side of point S. The position of the step is determined so as to match the inflow angle of the air after the cooling air and the mainstream air have mixed with each other. The upstream side shape of each step may be optional. The upstream side shape of each step may be formed by connecting a smooth curved line in some cases as shown in FIG. 10. However, the upstream side shape may be formed by connecting straight lines so as to have an apex also in some cases.

The tip-side end face is configured to have the steps as in the present embodiment; therefore, the shape of the leading edge of each step can optionally be formed. In addition to the configuration described above, a leading edge portion formed by the step is formed to have a curvature smaller than that of a leading edge 18. Thus, robustness for the variation in the inflow angle resulting from the mixing-in of the cooling air can be ensured. In addition, the occurrence of the rolling-up of cooling air can be suppressed. The turbine rotor blade is designed in consideration of the variation in the inflow angle resulting from the mixing-in of the cooling air. Therefore, it is possible to reduce a damage risk on the tip side of the blade and to optimize a work load.

Incidentally, as clear from FIGS. 9 and 10, the present embodiment exemplifies the case where the number of the steps at the tip-side end face 12 is three; however, the number of the steps may be four or more, or less than three.

Embodiment 3

Figure 11:
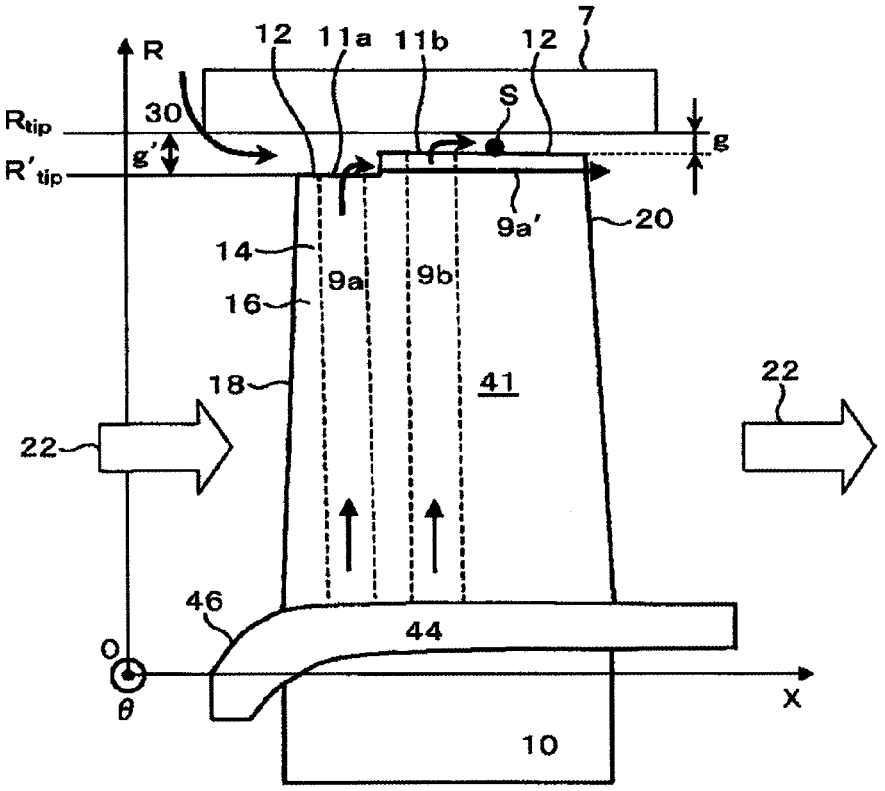
FIG. 11 is an explanatory diagram showing a meridian plane of a turbine blade according to a third embodiment of the present invention.

FIG. 11 illustrates a third embodiment. In the present embodiment, the radial position of the tip-side end face 12 of a turbine rotor blade is varied stepwise in a direction of a turbine rotational axis. This case adopts a configuration in which a clearance is large on then upstream side as illustrated in FIG. 11 and is reduced as it goes toward the downstream. The number of the steps of the tip-side end face 12 is two, which is reduced by one from the case in the second embodiment. With this configuration, also the turbine rotor blade of the present embodiment can reduce a total loss at the cross-section on the tip side thereof and a thermal load acting thereon, similarly to the turbine rotor blade of the first embodiment.

In FIG. 11, the flow of the air that has flowed down a cooling passage 9*a* to cool an airfoil 41 is denoted by reference numeral 9*a*'. An R-axis indicates a coordinate showing a distance of the airfoil 41 of the turbine rotor blade from the rotational axis. A positive direction indicates an increase in radial distance. Symbol $R_{tip}$ indicates a radial position on the airfoil 41 side of the casing 7. Symbol $R'_{tip}$ indicates the radial position of an end face where a radial distance is minimum, in the tip-side end face 12 of the airfoil 41. An area where the flow 9*a*' of air exists is included in an area (the range of symbol g') located between $R_{tip}$ and $R'_{tip}$. As described earlier, this is because the area where the cooling air 30 mixes with the mainstream gas 22 is reduced so that the cooling air flows on the blade surface. Thus, the cooling air cools the blade surface. The cooling air has an effect of shielding heat flux from the mainstream gas 22 toward the airfoil 41.

Figure 12:
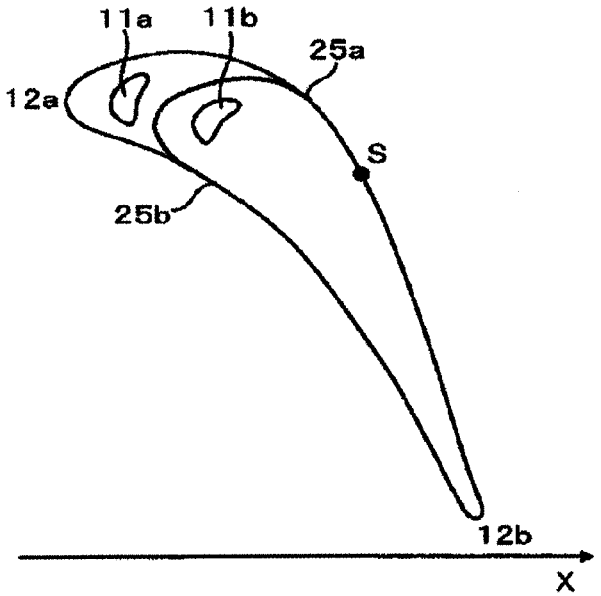
FIG. 12 is a cross-sectional view for assistance in explaining the turbine blade according to the third embodiment, taken at its radial position.

FIG. 12 illustrates the tip-side end face 12 encountered when the airfoil 41 shown in FIG. 11 is viewed from the casing 7 side. Reference numerals 11*a* and 11*b* denote discharge holes adapted to discharge to the mainstream gas passage the cooling air that has cooled the airfoil. Among the two air discharge holes, the air discharge hole 11*a* is located at a position where the radial position is lowest and the air discharge hole 11*b* is located at a position where the radial position is highest. The air discharge holes may have any size. The air exhaust hole may not exist in each step depending on the internal cooling structure of the blade.

What is important in the present embodiment is the shape of the leading end at the uppermost stream in the cross-sectional shape of each step. A point where a cross-section of the tip-side end face 12 which is present at the highest radial position and at which the air discharge hole 11*b* is located is in contact with the suction surface of the blade is denoted by reference numeral 25*a* and a point in contact with the pressure surface is denoted by reference numeral 25*b*. The point 25*a* is located upstream of a throat in the present embodiment. On the other hand, the position of the step is determined so as to match the inflow angle of the air after the cooling air and the mainstream air have mixed with each other. The upstream side shape of each step may be optional. The upstream side shape of each step may be formed by connecting a smooth curved line in some cases as shown in FIG. 12. However, the upstream side shape may be formed by connecting straight lines so as to have an apex also in some cases.

Embodiment 4

Figure 13:
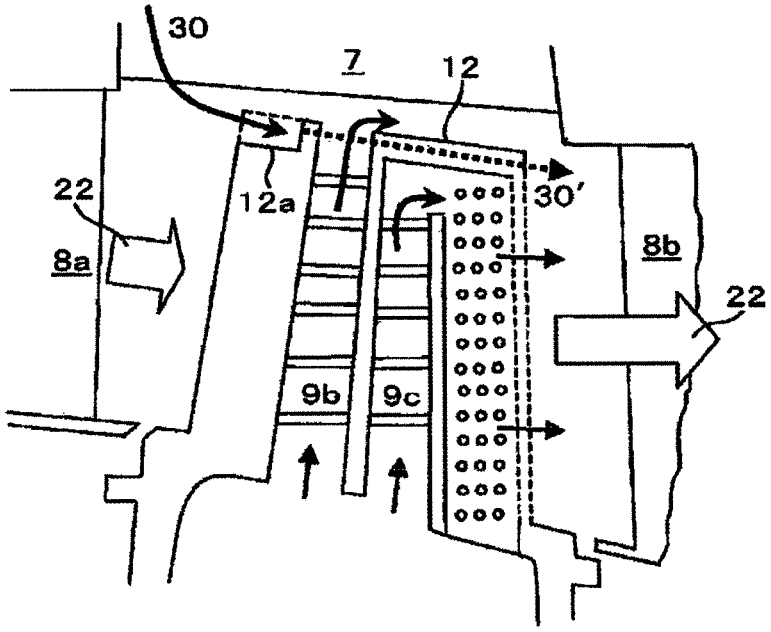
FIG. 13 is a cross-sectional view for assistance in explaining a turbine blade according to a fourth embodiment of the present invention, taken along a meridian plane thereof.

FIG. 13 illustrates a turbine rotor blade according to a fourth embodiment of the present invention. A solid line arrow denotes the flow of cooling air and a framed arrow denotes the flow of a hot gas, i.e., of a mainstream working gas. The rotor blade of the present embodiment corresponds to the case where a cooling passage 9*c* is installed in place of the discharge hole 11*a* installed in the rotor blade illustrated in FIG. 12.

As shown in FIG. 13, the cooling air that has been used for cooling is discharged to a mainstream gas passage and is mixed with a hot mainstream gas 22. In this case, as described in the second embodiment and the like, the step of a tip-side end face 12*a* inside a dotted line interferes with cooling air 30 mixing in from a casing 7 side. This suppresses the rolling-up of the cooling air in the direction of an average diameter. Thus, the cooling air flows along the blade as shown by arrow 30', which contributes to cooling the tip side of the blade.

Embodiment 5

Figure 14:
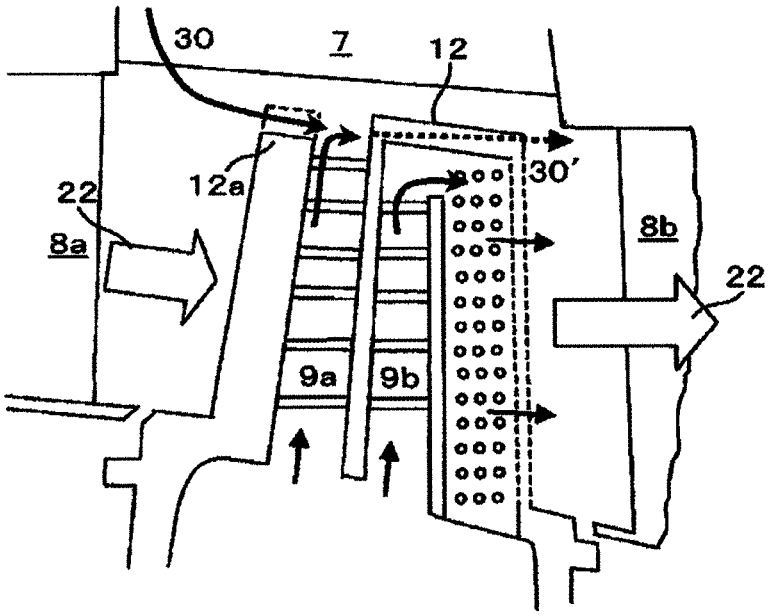
FIG. 14 is a cross-sectional view for assistance in explaining a turbine blade according to a fifth embodiment of the present invention, taken along a meridian plane thereof.

FIG. 14 illustrates another rotor blade according to a fifth embodiment by way of example. A solid line arrow denotes the flow of cooling air and a framed arrow denotes the flow of a hot gas, i.e., of a mainstream working gas. The rotor blade of the present embodiment corresponds to the case where only a discharge hole 11*a* is installed in FIG. 12. The cooling air that has flowed down the cooling passage 9*b* is used to cool pin fins and is discharged from the trailing edge side of the blade into a mainstream gas passage.

The cooling air 30 mixing in from a casing 7 side and the cooling air mixing in from the discharge hole 11*a* interfere with the rotor blade at the step of a tip-side end face 12*a* inside a dotted line. However, the step of the tip-side end face 12*a* of the rotor blade airfoil suppresses the rolling-up of the cooling air in the direction of an average diameter. This also contributes to cooling the tip side of the blade. In the present embodiment, the effect of cooling the blade surface is increased by the effect resulting from that the cooling air flowing down the cooling passage 9*a* and discharged into the mainstream gas flows along the blade surface, compared with the case of FIG. 13 of the fourth embodiment.

The step is located downstream of a cooling air discharge port as shown in FIG. 14; therefore, the cooling air discharged can be used to cool the blade portion on the tip 15 side of the airfoil.

Figure 15:
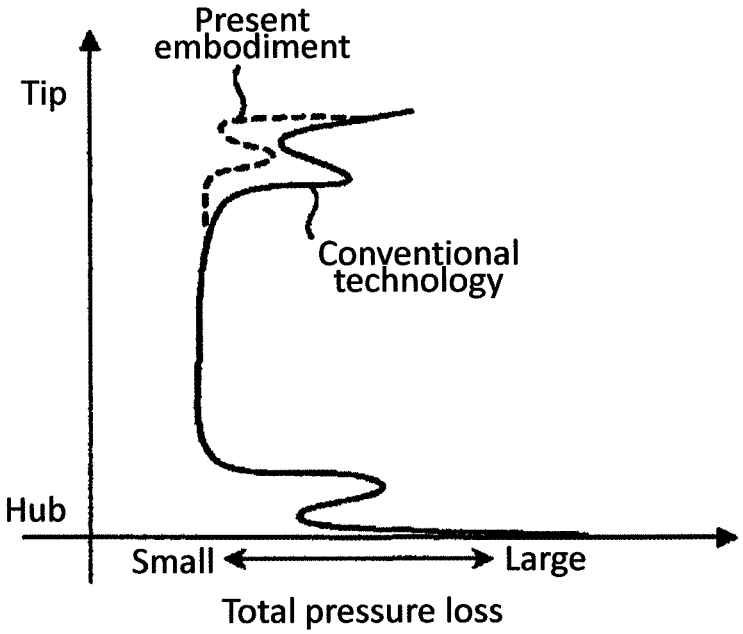
FIG. 15 is an explanatory view of a total pressure loss distribution of turbine blades.

FIG. 15 illustrates a total pressure loss in the vertical cross-section of an airfoil. In the conventional technology, a particularly remarkable total pressure loss in a blade cross-section appears on the tip side of the blade as indicated by a solid line. On the other hand, according to the present embodiment, a total pressure loss at the blade cross-section of a tip-side end wall is reduced as indicated by a broken line. In addition, a more uniform total pressure loss is achieved over the vertical direction of the airfoil. This means that more equal expansion work is achieved over the vertical direction of the airfoil. Thus, turbine efficiency and the efficiency of the steam turbine can be improved and fuel consumption of the gas turbine can be reduced.

Incidentally, the present invention is not limited to the embodiments described above. Embodiments that persons skilled in the art can easily reach on the basis the scope of claims are within the scope of the present invention. For the sake of ease, the above embodiments describe the clearance occurring between the tip-side end face of the airfoil and the casing by way of example. However, it is clear that the effects of the present invention can be produced even in a case where a clearance is a clearance occurring between the tip-side end face of the airfoil and a stationary member such as a shroud or the like mounted on the casing.

DESCRIPTION OF REFERENCE NUMERALS

1 Rotor
2 Stator
3 Rotational axis
4 Rotor blade
5 Compressor
6 Combustor
7 Casing
8 Stator blade
9*a*, 9*b*, 9*c* Cooling passage
9*f*$_1$, 9*f*$_2$ Fin
10 Blade root
11*a*, 11*b*, 11*c* Discharge hole
12 Tip-side end face of the rotor blade
13 Hub
14 Pressure surface
15 Tip
16 Suction surface
18 Leading edge
20 Trailing edge
22 Mainstream gas
41 Airfoil
44 Platform

The invention claimed is:

1. A turbine rotor blade mounted to a rotor to form a rotating turbine blade row, comprising:

a platform forming a gas passage through which a mainstream gas flows; and an airfoil extending from a gas passage plane in a radial direction in which a distance from a rotational axis of the rotor increases, the gas passage plane being a plane of the platform and forming the gas passage; wherein the airfoil has, in an end face of a tip-side thereof, an area where an inclination with respect to the rotational axis is varied, a blade height which is a length of the airfoil in the radial direction is configured such that a blade height at a leading edge of the airfoil is lower than a blade height at a throat position on a suction surface of the airfoil, the tip-side end face of the airfoil has a plurality of steps as the area where the inclination is varied, at a position between the leading edge and the throat position on the suction surface of the airfoil, cross-sections formed by the steps are continuous with the suction surface from the throat position on the suction surface or from an upstream side of the throat position, and a leading edge portion of the steps is formed to have a curvature smaller than that of a leading edge portion of a face at which a radial distance from the rotational axis is the shortest at the tip-side end face of the airfoil.

2. The turbine rotor blade according to claim 1, wherein the airfoil is internally provided with a cooling passage adapted to allow a cooling medium to flow.

3. The turbine rotor blade according to claim 2, wherein the tip-side end face of the airfoil is provided with a discharge hole adapted to discharge the cooling medium flowing down the cooling passage and the discharge hole is located on the upstream side of the step in the flow direction of the mainstream gas.

4. A gas turbine comprising:

a casing, which is a stationary member;

a rotor rotating in the casing; and a turbine rotor blade mounted to the rotor to form a turbine blade row rotating in the stationary member; wherein the turbine rotor blade includes a platform forming a gas passage through which a mainstream gas flows, and an airfoil extending from a gas passage plane in a radial direction vertical to a rotational axis of the rotor, the gas passage plane being a plane of the platform and forming the gas passage, the airfoil has a plurality of steps in an end face of a tip-side thereof, cross-sections formed by the steps are continuous with a suction surface of the airfoil from a throat position on the suction surface or from an upstream side of the throat position, a leading edge portion of the steps is formed to have a curvature smaller than that of a leading edge portion of a face at which a radial distance from the rotational axis is the shortest at the tip-side end face of the airfoil, and a clearance between the tip-side end face, which is a leading end-side end face of the airfoil, and the stationary member facing the tip-side end face is defined so that a clearance at a leading edge of the airfoil may be greater than that at a throat position on the suction surface of the airfoil.

5. A method for cooling a turbine rotor blade mounted to a rotor to form a turbine blade row rotating in a stationary member, the turbine rotor blade including a platform forming a gas passage through which a mainstream gas flows and an airfoil extending from a gas passage plane in a radial direction vertical to a rotational axis of the rotor, the gas passage plane being a plane of the platform and forming the gas passage, wherein the airfoil has a plurality of steps in an end face of a tip-side thereof, a blade height, which is a length of the airfoil in the radial direction, is higher on a downstream side in a flow direction of the mainstream gas than on an upstream side, a clearance between a tip-side end face, which is a leading end-side end face of the airfoil, and the stationary member facing the tip-side end face is defined to reduce stepwise in the flow direction of the mainstream gas, cross-sections formed by the steps are continuous with a suction surface of the airfoil from a throat position on the suction surface or from an upstream side of the throat position, a leading edge portion of the steps is formed to have a curvature smaller than that of a leading edge portion of a face at which a radial distance from the rotational axis is the shortest at the tip-side end face of the airfoil, the method comprising:

supplying a cooling medium to the plurality of steps to cool the tip-side of the airfoil.

* * * * *